US006668690B2

(12) United States Patent
Kikuchi et al.

(10) Patent No.: US 6,668,690 B2
(45) Date of Patent: Dec. 30, 2003

(54) SCREWDRIVER

(75) Inventors: Noriaki Kikuchi, Hitachinaka (JP); Hajime Kikuchi, Hitachinaka (JP); Masateru Niyada, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/138,421

(22) Filed: May 6, 2002

(65) Prior Publication Data

US 2002/0178877 A1 Dec. 5, 2002

(30) Foreign Application Priority Data

May 11, 2001 (JP) ..... 2001-141528
Feb. 8, 2002 (JP) ..... 2002-032413

(51) Int. Cl.[7] ..... B25B 23/57
(52) U.S. Cl. ..... 81/473; 81/467
(58) Field of Search ..... 81/467, 472–477

(56) References Cited

U.S. PATENT DOCUMENTS 2,184,394 A * 12/1939 Moretti ..... 81/467
2,827,779 A * 3/1958 Holloway ..... 81/474
4,440,049 A * 4/1984 Borne et al. ..... 81/467
5,735,183 A * 4/1998 Sasaki et al. ..... 81/473

FOREIGN PATENT DOCUMENTS

JP 8-267367 10/1996

* cited by examiner

*Primary Examiner*—D. S. Meislin
(74) *Attorney, Agent, or Firm*—McDermott, Will & Emery

(57) ABSTRACT

A longer life screwdriver is disclosed, and the screwdriver includes a ball retained in a through-hole in a manner movable in a radial direction of a driving shaft member, the through-hole being defined in a driving shaft member, the ball being possible to project beyond the driving shaft member along an outer circumference of the driving shaft member, the ball further being possible to abut an end of a clutch spring, and elements for allowing the ball to protrude beyond the driving shaft member along the outer circumference of the driving shaft member in response to axial movement of the output shaft member against a pressing member, the improvement comprising: disengagement elements for releasing engagement between the clutch spring and the ball during the reverse rotation of a motor.

8 Claims, 9 Drawing Sheets

SCREWDRIVER

BACKGROUND OF THE INVENTION

1. Field of the Invention

This invention relates to a screwdriver (mainly such as a power screwdriver) for use in tightening a screw into, e.g., a piece of plasterboard that is used such as on a ceiling and a wall.

2. Description of the Related Art

A screwdriver such as a power screwdriver is primarily intended for use on a fastened material such as a piece of plasterboard. The screwdriver includes an axially movable and adjustable stopper disposed on part of a unit body because a screw must be driven into the fastened material at a certain depth during screw tightening. The screwdriver further includes a screw-tightened depth adjuster for releasing a clutch when the unit body is moved to a position where the stopper abuts the fastened member during the screw tightening. The screwdriver yet further includes a mechanism for transmitting power through a one-way clutch when a motor is reversely revolved in order to back off the screw.

One such example of a prior art screwdriver as disclosed in Japanese Patent Application Laid-Out No. 8-267367 will now be described with reference to FIG. 1.

In FIG. 1, a threadingly engaged stopper sleeve 3 is shown mounted on a housing 2 at a distal end thereof. The stopper sleeve 3 is relatively rotated with respect to the housing 2, thereby adjusting a relative distance therebetween. The adjusted relative distance provides an adjusted screw-fed distance (or adjusted screw-driven depth).

In the housing 2, a pinion 19 on an output shaft of a motor (not shown) is engaged with a gear 5 that is circumferentially mounted on a driving shaft member 4. The driving shaft member 4 and the gear 5 are rotated as a one-piece component in a rotational direction of the driving shaft member 4, and motor rotation is transmitted to the driving shaft member 4 through the gear 5.

Referring to FIG. 2, a compression spring or a clutch spring 6 including axially extending upper and lower ends is shown coiled in a counterclockwise direction.

An output shaft member 7 includes engagement balls 18 that allow the output shaft member 7 to receive a screw-driving bit 10 in a jointly rotatable manner. A metal section 8 supports the output shaft member 7 in a pivotable and axially movable manner, but limits movement of the output shaft member 7 toward the screw-driving bit 10. Part of the output shaft member 7 is positioned within a one-way clutch 16. The one-way clutch 16 is retained within a driving shaft sleeve 4*a* of the driving shaft member 4. The output shaft member 7 is axially movable within the one-way clutch 16, while the one-way clutch 16 permits the output shaft member 7 to be pivoted in a single direction (in a direction in which a screw is tightened) with reference to the one-way clutch 16.

A non-rotatable, but axially movable locking member 12 is positioned against the stopper sleeve 3 at an end thereof toward the driving shaft member 4. The locking member 12 is always urged toward the stopper sleeve 3 by means of a compression spring 11. The stopper sleeve 3 and the locking member 12 includes convex and concave claws, respectively, which claws are in constant mesh with one another at a position where the locking member 12 abuts the stopper sleeve 3. When the claw of the stopper sleeve 3 is held in mesh with that of the locking member 12, then the stopper sleeve 3 is locked against rotation with respect to the housing 2, and is further immovable in an axial direction of the stopper sleeve 3. The screw-tightened depth can be adjusted by the stopper sleeve 3 being relatively rotated in relation to the housing 2 when an operator disengages the claw of the stopper sleeve 3 from that of the locking member 12 by manually sliding the locking member 12 toward the driving shaft member 4 against the spring force of the compression spring 11.

In the driving shaft member 4, an axially movable umbrella-like member 13 is positioned against the output shaft member 7 at an end thereof in a direction opposite to the screw-driving bit 10. A radially movable ball 9 within a through-hole 4*b* of the driving shaft sleeve 4*a* is seated against the umbrella-like member 13 along the outer circumference thereof or rather a tapered portion 13*a*. A spring 15 constantly urges the umbrella-like member 13 toward the output shaft member 7.

In FIG. 1, the pressing force of the spring 15 causes the output shaft member 7 having the screw-driving bit 10 disposed thereon to be moved in a downward direction of FIG. 1 through the umbrella-like member 13, and a distal end of the bit 10 remains projecting beyond that of the stopper sleeve 3.

When driving the screw is started in such a state, then output shaft member 7 with the screw-driving bit 10 thereon is axially moved in an upward direction of FIG. 1 through the umbrella-like member 13 against the pressing force of the spring 15.

The tapered portion 13*a* is slanted at an angle that permits an outer diameter thereof to decrease with an increase in distance between the tapered portion 13*a* and the output shaft member 7. Such a construction allows ball 9 on the tapered portion 13*a* to protrude beyond the driving shaft sleeve 4*a* along the outer circumference thereof in response to the axial movement of the output shaft member 7 with the screw-driving bit 10.

An output shaft sleeve 7*a* having the same outer diameter as that of the driving shaft sleeve 4*a* is disposed on the output shaft member 7. The output shaft sleeve 7*a* includes a fixing portion 14*a* and a protruding portion 14*b*. The fixing portion 14*a* secures an end of the clutch spring 6 that extends about the output shaft sleeve 7*a* and driving shaft sleeve 4*a* along the respective outer circumferences thereof. The protruding portion 14*b* extends beyond the output shaft sleeve 7*a* along the outer circumference thereof, and abuts an end surface of the clutch spring 6, thereby restricting the clutch spring 6 in axial position thereof. As illustrated in FIGS. 2 and 3, the clutch spring 6 has the bent end secured by the fixing portion 14*a*, and is thereby disposed in an axially immovable fashion.

The opposite end 6*a* of the clutch spring 6 toward the driving shaft member 4 is a free end, and the clutch spring end 6*a* is axially moved in union with the axially moved output shaft member 7 having the bit 10 carried thereon.

When the output shaft member 7 with the screw-driving bit 10 is axially moved against the spring force of the spring 15 during screw tightening, then the clutch spring end 6*a* is axially moved in union with the output shaft member 7, and is then positioned on the ball 9 along the circumference thereof. The umbrella-like member 13 is axially moved in response to the movement of the output shaft member 7 with the screw-driving bit 10, and the tapered portion 13*a* causes the ball 9 to protrude beyond the driving shaft sleeve 4*a* along the outer circumference thereof. As a result, the clutch spring end 6*a* can be brought into contact with the ball 9 in a rotational direction of the driving shaft member 4, and a motor rotational force is transmitted to the clutch spring 6 through the gear 5, driving shaft member 4, and ball 9.

When a motor is normally revolved, then the clutch spring 6 is deformed in a direction in which an outer diameter of the clutch spring 6 is reduced, and is thereby wound around the driving shaft sleeve 7*a* as well as the output shaft sleeve 4*a* along the respective outer circumferences thereof, thereby rotating the output shaft sleeve 4*a* jointly with the driving shaft sleeve 7*a*. As a result, the revolving force of the driving shaft member 4 is transmitted to the output shaft member 7 through the clutch spring 6 in order to revolve the screw-driving bit 10, thereby tightening the screw.

When the screw is further driven, then an end surface of the stopper sleeve 3 is brought into contact with the fastened member, and the pressing force of the spring 15 causes the output shaft member 7 as well as the screw-driving bit 10 to be axially moved toward the distal end of the screw-driving bit 10 in response to further screw tightening. When the output shaft member 7 with the screw-driving bit 10 thereon is moved toward the distal end of the screw-driving bit 10 by a certain amount, then the ball 9 in abutment with the tapered portion 13*a* is retracted away from the circumference of the driving shaft sleeve 4*a*, which otherwise would remain protruding beyond the driving shaft sleeve 4*a* along the circumference thereof. As a result, the clutch spring 6 is unwound and then released from the sleeves 4*a* and 7*a*, and the output shaft member 7 with the screw-driving bit 10 is isolated from the revolving force, thereby completing the screw tightening.

In the prior art screwdriver as discussed above, the ball 9 and the clutch spring end 6*a* are brought into contact with one another in the revolving direction of the driving shaft member 4 during normal rotation of the motor that runs in order to drive the screw, and the clutch spring 6 is deformed in a direction in which an inner diameter thereof is reduced, thereby rotating the output shaft member 7 in union with the driving shaft member 4. As a result, the revolving force of the driving shaft member 4 is transmitted to the screw-driving bit 10 as well as the output shaft member 7. When the motor is reversely rotated in order to back off the screw, then the revolving force of the driving shaft member 4 is transmitted to the screw-driving bit 10 as well as the output shaft member 7 through the one-way clutch 16. However, there exists a drawback to the prior art screwdriver. More specifically, when the one-way clutch 16 is idled, then the ball 9 is brought into contact with the clutch spring end 6*a* as illustrated in FIG. 5 during movement of the output shaft member 7 in a direction in which the output shaft member 7 resists the pressing force of the spring 15. When the ball 9 collides with the clutch spring 6, then the clutch spring 6 experiences a load that acts in a direction as shown by an arrow in FIG. 5. As a result, the clutch spring 6 is deformed in a direction in which then inner diameter thereof expands as seen from FIG. 6, and the clutch spring 6 is immediately plastically deformed or otherwise broken. Consequently, the screwdriver is mal-functioned or otherwise rendered inoperative.

The one-way clutch 16 tends to be idled when the output shaft member 7 is axially moved with respect to the one-way clutch 16 upon motor start-up.

When the ball 9 is driven into contact with the clutch spring end 6*a* after idling of the one-way clutch 16 during screw loosening as previously discussed, then the clutch spring 6 is deformed in a direction in which the clutch spring 6 expands toward any space within the housing 2. Such deformation reduces an axial dimension of the clutch spring 6, and the clutch spring end 6*a* is disengaged from the ball 9. However, a large volume of torque must be exerted on the clutch spring 6 during such disengagement, and the clutch spring 6 is immediately plastically deformed or otherwise broken. As a result, the screwdriver is either brought out of normal service or rendered inoperative.

SUMMARY OF THE INVENTION

In view of the above, an object of the present invention is to provide a longer life screwdriver including a clutch spring resistant to plastic deformation and breakage when a ball abuts a clutch spring end after idling of a one-way clutch during screw loosening.

The above object is achieved by disengagement means for releasing engagement between the clutch spring and the ball during reverse motor rotation.

The above object is accomplished by a slanted surface on the clutch spring at the clutch spring end where the clutch spring is positioned against the ball during reverse motor rotation.

The above object is attainable by a through-hole configured to allow the ball to be moved away from an immovable shaft member when the ball is forced against the clutch spring during reverse motor rotation, part of the clutch spring being secured to the immovable shaft member.

DETAILED DESCRIPTION OF THE PREFERRED EMBODIMENTS

A clutch spring of a screwdriver according to an embodiment of the present invention will now be described with reference to FIGS. 7 and 8.

Figure 1:
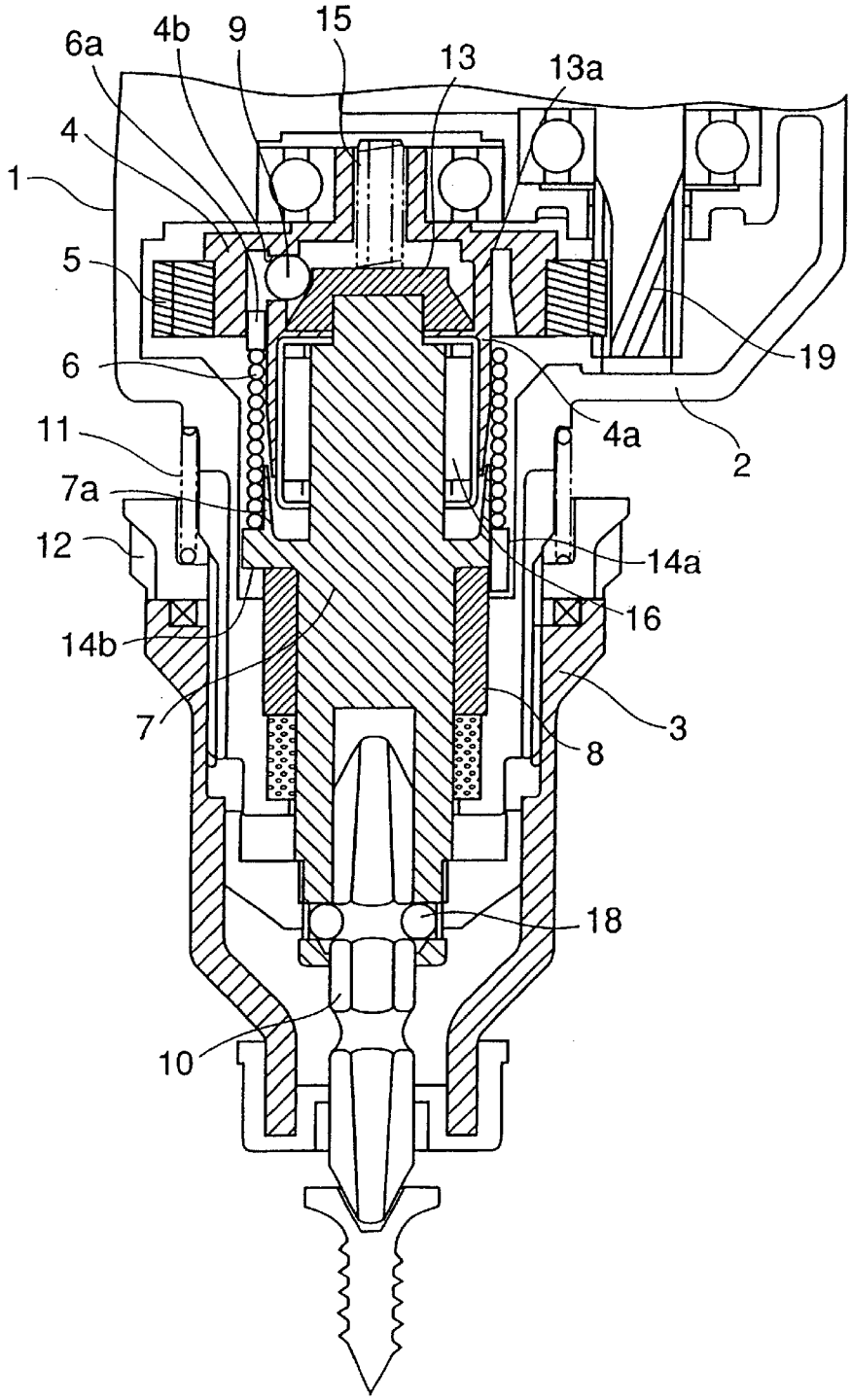
FIG.1 PRIOR ART
FIG. 1 is an enlarged cross-sectional view, illustrating an essential portion of a prior art screwdriver as an illustration.
Figure 2:
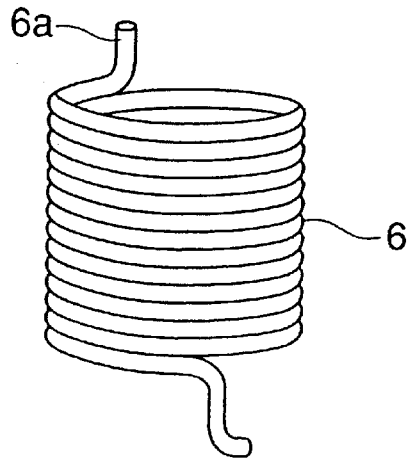
FIG.2 PRIOR ART
FIG. 2 is a perspective view, illustrating an example of a prior art clutch spring used in the screwdriver.
Figure 3:
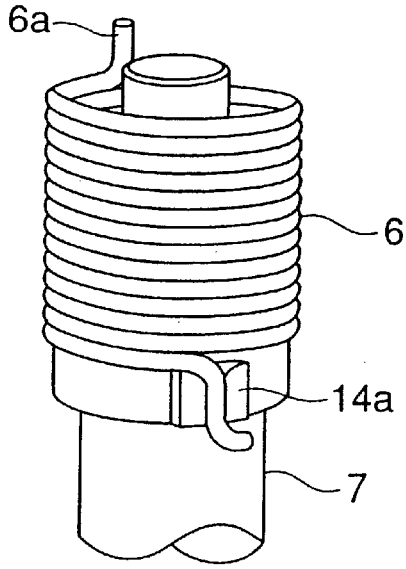
FIG.3 PRIOR ART
FIG. 3 is a perspective view, illustrating the clutch spring secured to an output shaft member.
Figure 7:
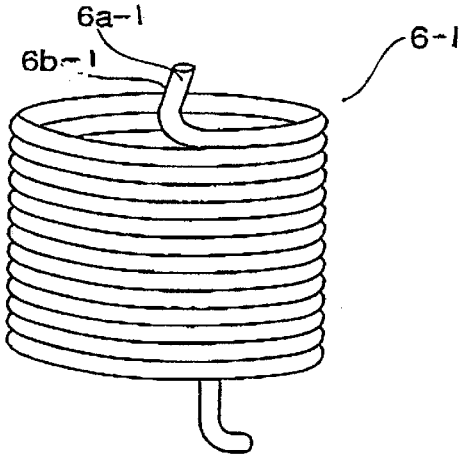
FIG. 7 is a perspective view, illustrating a clutch spring of a screwdriver according to an embodiment of the present invention.
Figure 8:
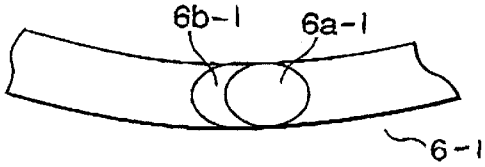
FIG. 8 is an enlarged view, illustrating an essential portion of the clutch spring.

As illustrated in FIGS. 7 and 8, a clutch spring 6-1 has a slanted surface **6*b*-1 formed at a deformed end 6*a* thereof. In a screwdriver as illustrated in FIG. 1 in which the clutch spring 6-1 is employed, when the ball 9 is driven against the clutch spring end 6*a*-1 during reverse motor rotation, then the clutch spring 6-1 is deformable by a dramatically reduced amount in a radially extending direction of the clutch spring 6-1. More specifically, when the clutch spring end 6*a*-1 abuts the ball 9 during the reverse motor rotation, then the ball 9 contacts the slanted surface 6*b*-1 and an impact force of the ball 9 on the clutch spring end 6*a*-1 in a rotational direction of the clutch spring 6-1 can be dispersed axially or in a direction in which the clutch spring end 6*a* is disengaged from the ball 9. The axially dispersed impact force causes the clutch spring 6-1 to be at first deformed in a direction in which the clutch spring 6-1 is slightly expanded, and then to be deformed in a direction in which the clutch spring 6-1 is reduced in axial dimension thereof As a result, the clutch spring end 6*a*-1 is disengaged from the ball 9. In conclusion, the clutch spring 6-1 according to the present embodiment is deformable by a reduced amount of nearly one fifth as low as the prior art clutch spring 6-1. The clutch spring 6-1 in contact with the ball 9** is deformed only by an amount less than a plastically deformable degree, and enjoys an improved lifetime.

Figure 5:
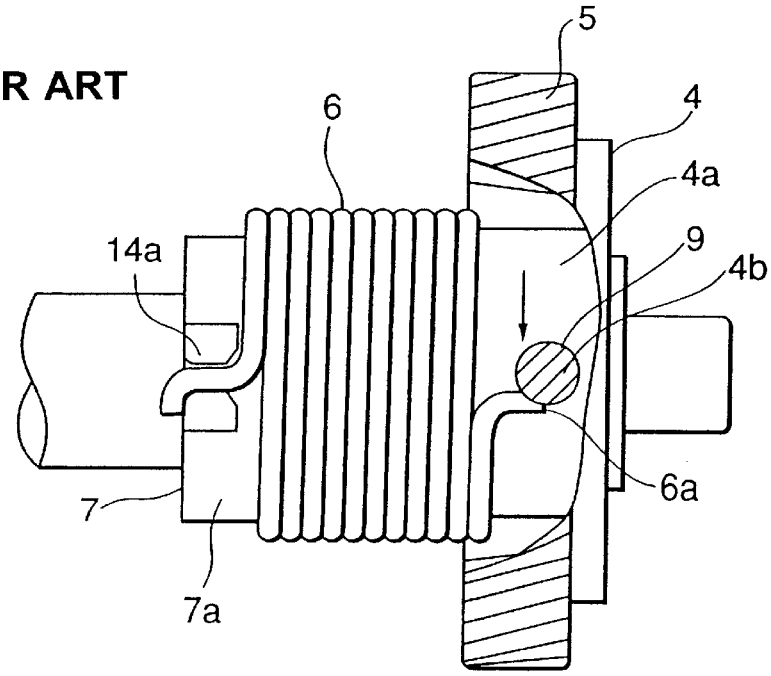
FIG.5 PRIOR ART
FIG. 5 is a descriptive illustration, showing how components in the prior art screwdriver behave.
Figure 6:
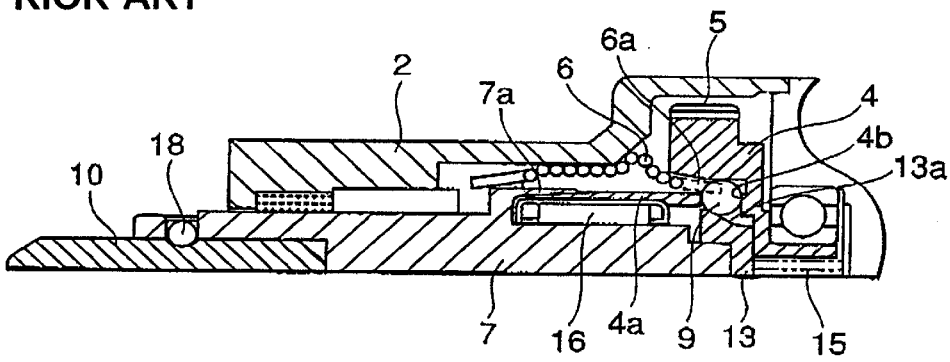
FIG.6 PRIOR ART
FIG. 6 is an enlarged cross-sectional view of an essential portion of the prior art screwdriver, illustrating how components in the screwdriver behave.

In the prior art screwdriver, when the one-way clutch 16 is idled during reverse motor rotation or screw loosening, then abutment of the clutch spring end **6*a*-1 with the ball 9 causes the clutch spring 6-1 to be deformed in the radially extending direction thereof to the point where the clutch spring 6-1 abuts an inner surface of the housing 2, as illustrated in FIG. 5. In the screwdriver according to the present invention, when the ball 9 is driven against the clutch spring end 6*a*-1 after idling of the one-way clutch 16 during screw loosening, then the slanted surface 6*b*-1 of the clutch spring end 6*a*-1 disengages the clutch spring end 6*a*-1 from the ball 9 although the clutch spring 6-1 is deformed by a very small amount in the radially extending direction thereof. Such disengagement limits the radially expanding deformation of the clutch spring 6-1 and there is no likelihood that the clutch spring 6-1 is forced against the inner surface of the housing 2**.

The slanted surface **6*b*-1 is beveled in a direction opposite to a coiled direction of the clutch spring 6-1 as a distal end of the clutch spring end 6*a*-1** is reached.

A clutch spring according to another embodiment will now be described with reference to FIGS. 9 and 10.

Figure 9:
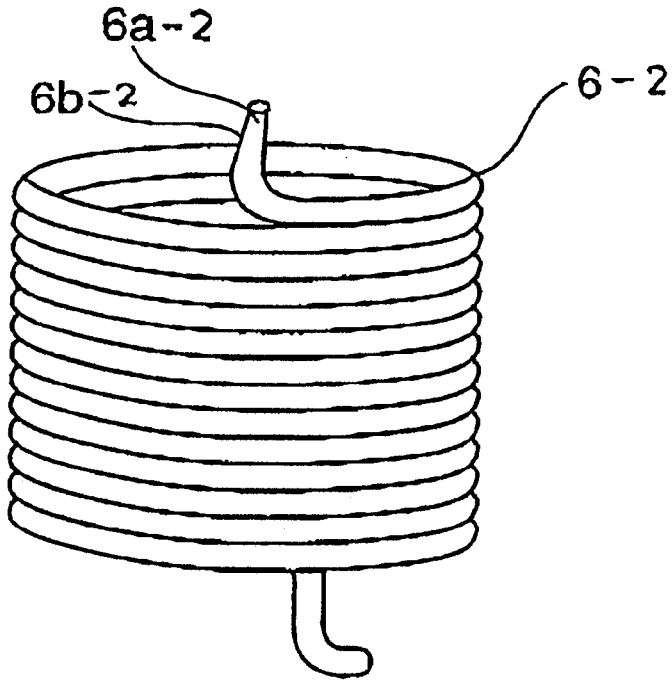
FIG. 9 is a perspective view, illustrating a clutch spring according to another embodiment.
Figure 10:
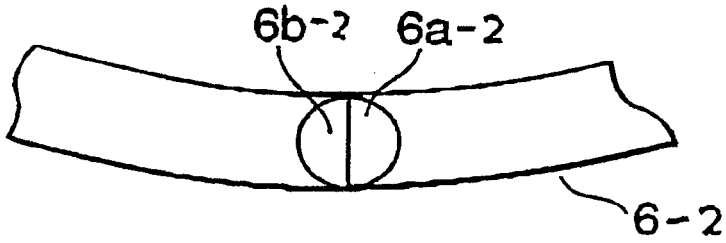
FIG. 10 is an enlarged view, illustrating an essential portion of the clutch spring.

As illustrated in FIGS. 9 and 10, a clutch spring 6-2 has a slanted surface **6*b*-2 formed only on one side of a clutch spring end 6*a*-2. When the one-way clutch 16 is idled during reverse motor rotation, then the ball 9 is driven into contact with the clutch spring 6-2 at a position where the slanted surface 66*b* is located. The slanted surface 6*b*-2 is formed by the prior art clutch spring 6-2 being removed. Such a construction of the clutch spring 6-2 makes it feasible to limit the deformation of the clutch spring 6-2 in a manner similar to the previously discussed clutch spring 6-1 as illustrated in FIGS. 7 and 8 when the ball 9 and the clutch spring end 6*a*-1 are brought into contact with one another during reverse motor rotation. In the previously discussed clutch spring 6-1 as illustrated in FIGS. 7 and 8, the clutch spring end 6*a*-1 is inclined to provide the slanted surface 6*b*-1 and the clutch spring end 6*a*-l and the ball 9 are prone to coming into unsteady engagement and disengagement from one another during normal motor rotation. Such a shortcoming can be overcome by the present embodiment in which the slanted surface 6*b*-2 is located only on one side of the clutch spring end 6*a*-2 as illustrated in FIGS. 9 and 10**.

Figure 11:
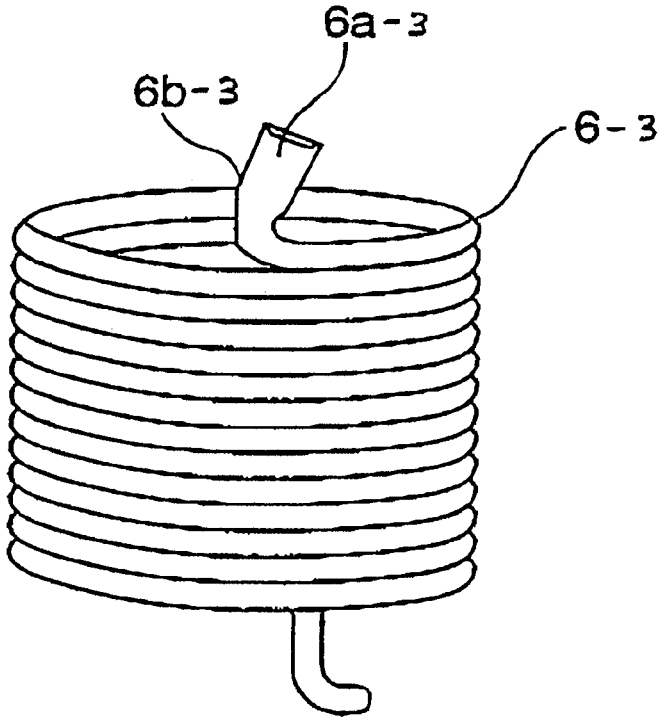
FIG. 11 is a perspective view, showing a clutch spring according to a further embodiment.
Figure 12:
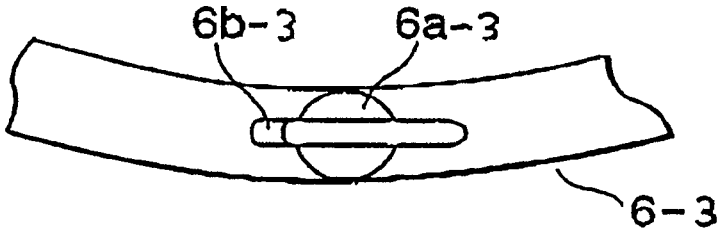
FIG. 12 is an enlarged view, illustrating an essential portion of the clutch spring.

FIGS. 11 and 12 illustrate a clutch spring 6-3 according to a further embodiment. In the clutch spring 6-3, a clutch spring end **6*a*-3 has a slanted surface 6*b*-3 inclined in a direction opposite to a coiled direction of the clutch spring 6-3 in a manner similar to the previous embodiment as illustrated in FIGS. 7 and 8. In addition, as seen from FIG. 12, the slanted surface 6*b*-3 is shortened and flattened in cross-section in a radial direction of the coiled clutch spring 6-3. Such a configuration provides effects and operation similar to those in the previous embodiment as illustrated in FIGS. 7 and 8. When the slanted surface 6*b*-3 causes the clutch spring 6-3 according to the present embodiment to be slightly made smaller in axial dimension in response to radially expanding deformation of the clutch spring 6-3, then the thinned clutch spring end 6*a*-3 is moved beyond a spherical surface of the ball 9, thereby permitting the clutch spring end 6*a*-3 to travel a reduced distance that requires the clutch spring end 6*a*-3 to be disengaged from the ball 9. As a result, the clutch spring 6-3 is deformable by a proportionally reduced amount. The clutch spring 6-3 according to the present embodiment is formed by the clutch spring end 6*a*3** being crushed, and is easily attainable.

Figure 13:
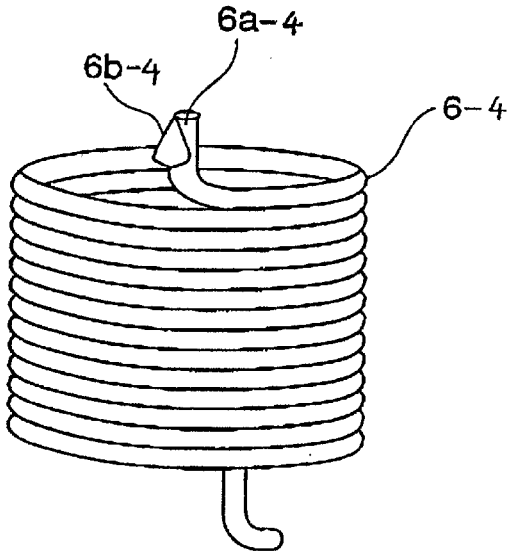
FIG. 13 is a perspective view, showing a clutch spring according to a yet further embodiment.
Figure 14:
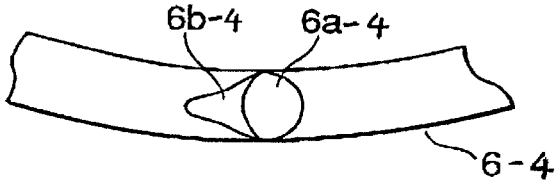
FIG. 14 is an enlarged view, illustrating an essential portion of the clutch spring.

FIGS. 13 and 14 illustrate a clutch spring 6-4 according to a yet further embodiment. The clutch spring 6-4 is shortened and flattened in cross-section in a radial direction of the coiled clutch spring 6-4. Such a shortened and flattened portion is formed only on one side of a clutch spring end **6*a*-4 in a rotational direction of the clutch spring 6-4. A slanted surface 6*b*-4 is formed on the clutch spring end 6*a*-4 at the flattened portion. This arrangement provides effects similar to those in the previous embodiment as illustrated in FIGS. 11 and 12, and further allows an abutment force similar to that in the prior art clutch spring 6 to be obtained at the clutch spring end 6*a*-4 where the ball 9 abuts the clutch spring end 6*a*-4** during normal motor rotation.

Alternatively, the clutch spring 6-1 as illustrated in FIGS. 7 and 8 may be combined with either one of the clutch springs 6 as shown in FIGS. 9–14, and the combined clutch spring 6 is deformable by a further reduced amount.

A driving shaft member of the screwdriver according to an embodiment of the present invention will now be described with reference to FIGS. 15 and 16.

Pursuant to the present embodiment, when the output shaft member 7 having the screw-driving bit 10 carried thereon is axially moved against the pressing force of the spring 15, then the tapered portion 13a between the output shaft member 7 and the spring 15 permits the ball 9 to be moved in a radial direction of the driving shaft member 4-1 and then to protrude beyond the driving sleeve **4*a*-1 along the outer circumference thereof the driving sleeve 4*a*-1 is defined with a suitably shaped through-hole 4*b*-1 for retaining the ball 9 therein. This construction allows the clutch spring end 6***a*-2 to be disengaged from the ball 9 when the ball 9 is brought into contact with the clutch spring end 6*a*-2 after idling of the one-way clutch 16 during reverse motor rotation.

Figure 4:
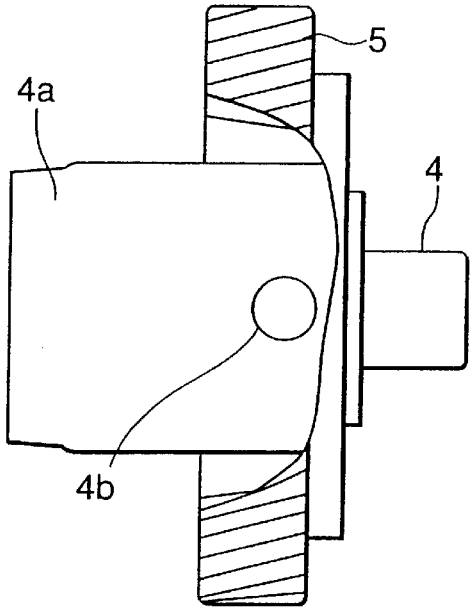
PRIOR ART FIG.4
FIG. 4 is a view, partially illustrating an essential portion of a prior art driving shaft member as an illustration.
Figure 15:
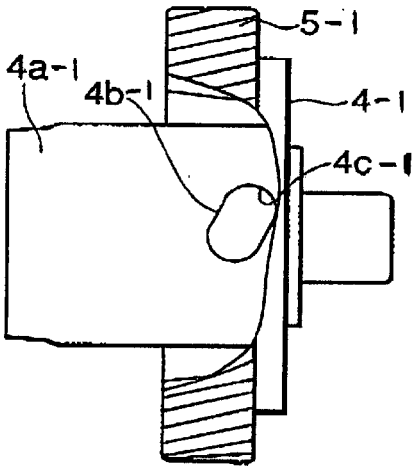
FIG. 15 is a partially omitted view, illustrating a driving shaft member of the screwdriver according to an embodiment of the present invention.
Figure 16:
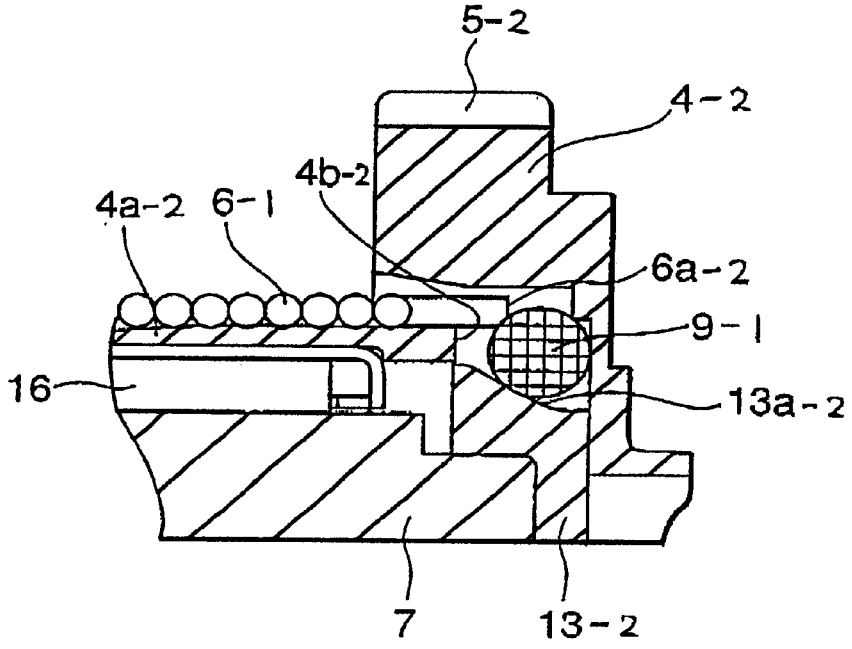
FIG. 16 is an enlarged view, illustrating an essential portion of the screwdriver according to an embodiment.
Figure 17:
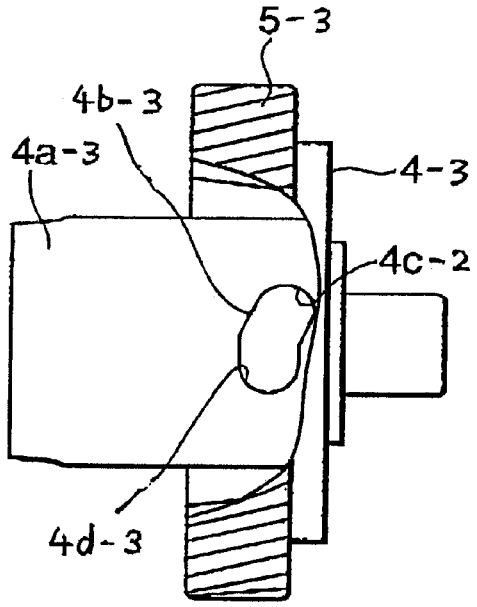
FIG. 17 is a partially omitted view, illustrating a driving shaft member of the screwdriver according to another embodiment.
Figure 18:
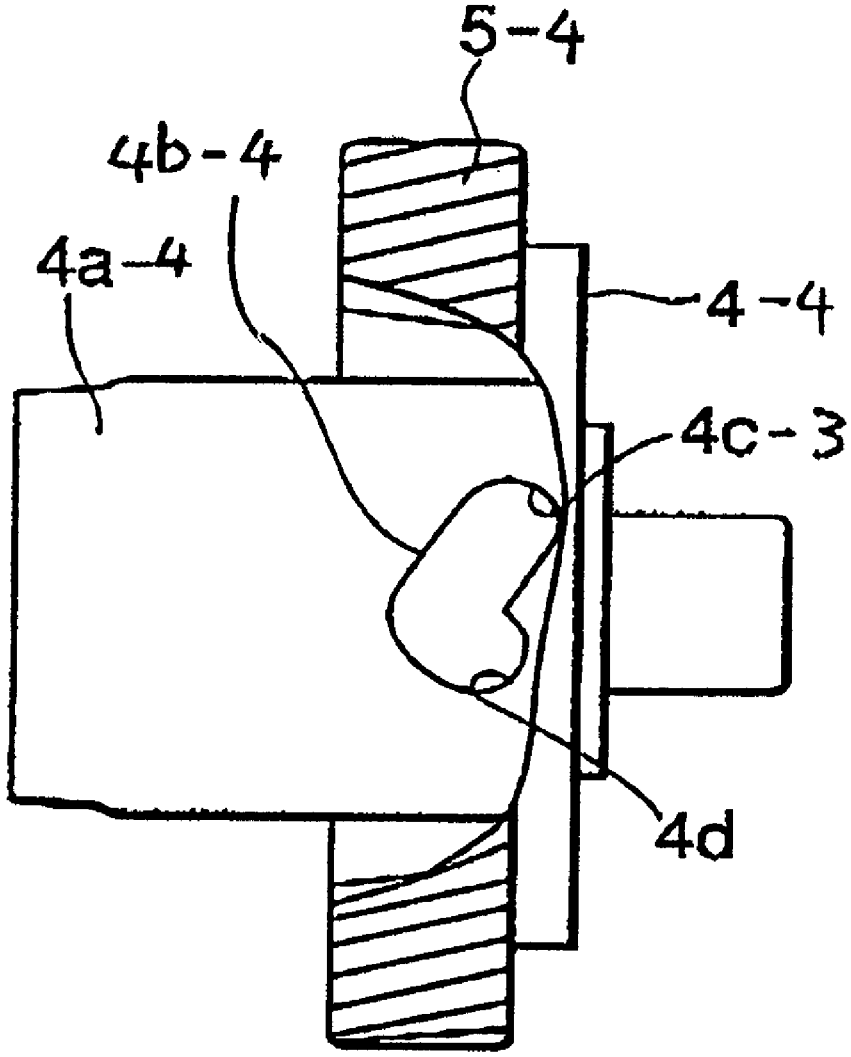
FIG. 18 is a partially omitted view, illustrating a driving shaft member of the screwdriver according to still another embodiment.

The through-hole 4*b*1 primarily forms a common shape as shown in FIG. 4, but is secondarily defined with a relief aperture 4*c*-1 as illustrated in FIG. 15. The relief aperture 4*c*-1 is shaped to allow the ball 9 to move away from the output shaft member 7.

The presence of the relief aperture 4*c*-l causes the through-hole 4*b*-1 to be shaped to slant in a direction opposite to reverse rotation of the driving shaft member 4-1 and further to extend in a direction away from the output shaft member 7.

In the screwdriver as illustrated in FIG. 1 in which the above-structured driving shaft member 4-1 is employed, the ball 9 is seated within the through-hole 4*b*-1 at the same position as that in the prior art screwdriver during normal motor rotation for screw tightening, thereby bringing the ball 9 into contact with the clutch spring end 6*a*. As a result, the screwdriver is capable of screw tightening in a manner similar to the prior art screwdriver. A centrifugal force caused by rotation of the driving shaft member 4-1 permits the ball 9 to ride upward on the tapered portion 13*a* before the ball 9 is seated within the though-hole 4*b*-1 at the same position as that in the prior art screwdriver.

When the ball 9 is brought into contact with the clutch spring end 6*a* after idling of the one-way clutch 16 during reverse motor rotation for screw loosening, then the ball 9 within the through-hole 4*b*1 is positioned against the clutch spring end 6*a* in a state of traveling toward the relief aperture 4*c*-1. The abutment of the ball 9 with the clutch spring end 6*a* moves the ball 9 into the relief aperture 4*c*-1. The ball 9 is moved away from the clutch spring end 6*a,* and is forced into contact with the clutch spring end 6*a* near a distal end thereof. The clutch spring 6 is reduced in size in an axial direction thereof by an amount of a coil when the driving shaft member 4-1 is rotated once with respect to the output shaft member 7. As a result, the clutch spring 6 is slightly deformed in a radially extending direction thereof, and the clutch spring end 6*a* is disengaged from the ball 9. In this way, the clutch spring 6 is deformable by a small amount, and is resistant to plastic deformation or otherwise breakage.

The ball 9 moved away from the clutch spring end 6*a*-2 as discussed above is positioned against the tapered portion 13*a*-2 at different positions, and projects beyond the driving sleeve 4*a*-2 along the outer circumference thereof by a reduced amount. Consequently, the ball 9-1 is forced into contact with the clutch spring end 6*a*-2 on an inner surface thereof in the radial direction of the clutch spring 6d, as illustrated in FIG. 16, and the clutch spring end 6*a*-2 is caused to ride over the ball 9-1. As a result, the clutch spring 6-1 experiences less torque.

When the clutch spring end 6*a*-2 and the ball 9 are held in contact with one another on a slanted surface of the driving shaft member 4-2 in the rotational direction of the driving shaft member 4-2 then the clutch spring end 6*a*-2 further tends to ride over the ball 9-1 and the clutch spring 6-1 undergoes further reduced torque.

Pursuant to the above embodiment, the ball 9-1 projects beyond the driving sleeve 4*a*-2 along the outer circumference thereof by a small amount when the ball 9-1 is seated within the relief aperture 4*c*-1. Alternatively, the screwdriver may be designed to permit the ball 9-1 to avoid projecting beyond the driving sleeve 4*a*-2 along the outer circumference thereof when the ball 9-1 stays in the relief aperture 4*c*-1. Such an alternative arrangement insures that the ball 9-1 is prevented from coming into contact with the clutch spring end 6*a*-2 during reverse motor rotation.

Pursuant to the above embodiment, the ball 9-1 can be brought into slight contact with the clutch spring end 6*a*-2 when being positioned in the relief aperture 4*c*-1. Alternatively, the screwdriver may be sized to force the ball 9-1 into non-contact with the clutch spring end 6*a*-2 when the ball 9-1 is located within the relief aperture 4*c*-1.

As detailed above, the present embodiment provides disengagement means for releasing engagement between the clutch spring end and the ball during reverse motor rotation. As a result, such disengagement is achievable without the possibility of plastic deformation or otherwise breakage of the clutch spring. This feature provides a longer life screwdriver.

What is claimed is:

1. In a screwdriver including a normally and reversely operable motor, a driving shaft member for transmitting power from the motor, a cylindrical member disposed on the driving shaft member, an output shaft member for retaining a screw-driving bit, the output shaft member being supported in an axially movable manner, a cylindrical member disposed on the output shaft member, pressing means for causing the output shaft member and the driving shaft member to be spaced apart from one another, a coiled clutch spring positioned in a coaxial direction of the driving shaft member and the output shaft member in a state of extending over the respective cylindrical members on the output shaft member and the driving shaft member, the clutch spring having one end secured to one of the output shaft member and the driving shaft member and having the other end held against the other of the output shaft member and the driving shaft member in a response to movement of the output shaft member, a one-way clutch disposed between the output shaft member and the driving shaft member, a ball retained in a through-hole in a manner movable in a radial direction of the other of the output shaft member and the driving shaft member, the through-hole being defined in the other of the output shaft member and the driving shaft member, the ball being possible to project beyond the cylindrical member on the other of the output shaft member and the driving shaft member along an outer circumference of the cylindrical member, the ball further being possible to abut an end of the clutch spring, and means for allowing the ball to protrude beyond the cylindrical member of the other of the output shaft member and the driving shaft member alone the outer circumference of the cylindrical member in response to axial movement of the output shaft member against the pressing means, in which a revolving force is transmitted from the driving shaft member to the output shaft member through the clutch spring during normal rotation of the motor, thereby tightening a screw, but the revolving force is transmitted from the driving shaft member to the output shaft member through the one-way clutch during reverse rotation of the motor, thereby loosening the screw, the improvement comprising:

disengagement means for releasing engagement between the clutch spring and the ball during the reverse rotation of the motor, wherein the disengagement means is a slanted surface formed on the clutch spring at the end of the clutch spring where the ball and the clutch spring are forced against one another when the motor is reversely rotated.

2. The screwdriver as defined in claim 1, wherein the slanted surface is formed by the end of the clutch spring being machined.

3. The screwdriver as defined in claim 1, wherein the slanted surface is formed by the end of the clutch spring being deformed.

4. In a screwdriver including a normally and reversely operable motor, a driving shaft member for transmitting power from the motor, a cylindrical member disposed on the driving shaft member, an output shaft member for retaining a screw-driving bit, the output shaft member being supported in an axially movable manner, a cylindrical member disposed on the output shaft member, pressing means for causing the output shaft member and the driving shaft member to be spaced apart from one another, a coiled clutch spring positioned in a coaxial direction of the driving shaft member and the output shaft member in a state of extending over the respective cylindrical members on the output shaft member and the driving shaft member, the clutch spring having one end secured to one of the output shaft member and the driving shaft member and having the other end held against the other of the output shaft member and the driving shaft member in a response to movement of the output shaft member, a one-way clutch disposed between the output shaft member and the driving shaft member, a ball retained in a through-hole in a maimer movable in a radial direction of the other of the output shaft member and the driving shaft member, the through-hole being defined in the other of the output shaft member and the driving shaft member, the ball being possible to project beyond the cylindrical member on the other of the output shaft member and the driving shaft member along an outer circumference of the cylindrical member, the ball further being possible to abut an end of the clutch spring, and means for allowing the ball to protrude beyond the cylindrical member of the other of the output shaft member and the driving shaft member along the outer circumference of the cylindrical member in response to axial movement of the output shaft member against the pressing means, in which a revolving force is transmitted from the driving shaft member to the output shaft member through the clutch spring during normal rotation of the motor, thereby tightening a screw, but the revolving force is transmitted from the driving shaft member to the output shaft member through the one-way clutch during reverse rotation of the motor, thereby loosening the screw, the improvement comprising:

disengagement means for releasing engagement between the clutch spring and the ball during the reverse rotation of the motor, wherein the disengagement means is a through-hole shaped to permit the ball to be moved away from an immovable shaft member when the ball and the clutch spring are driven against one another during reverse rotation of the motor, part of the clutch spring being secured to the immovable shaft member, and the through-hole includes a relief aperture that is slanted in an axial direction of the output shaft member.

5. The screwdriver as defined in claim 4, wherein the through-hole is substantially L-shaped.

6. The screwdriver as defined in claim 4, wherein the ball seated within the relief aperture is precluded from protruding beyond the shaft member along the outer circumference of the shaft member.

7. The screwdriver as defined in claim 6, wherein the clutch spring has the end shortened and flattened in a radial direction of the clutch spring.

8. In a screwdriver including a normally and reversely operable motor, a driving shaft member for transmitting power from the motor, a cylindrical member disposed on the driving shaft member, an output shaft member for retaining a screw-driving bit, the output shaft member being supported in an axially movable manner, a cylindrical member disposed on the output shaft member, pressing means for causing the output shaft member and the driving shaft member to be spaced apart from one another, a coiled clutch spring positioned in a coaxial direction of the driving shaft member and the output shaft member in a state of extending over the respective cylindrical members on the output shaft member and the driving shaft member, the clutch spring having one end secured to one of the output shaft member and the driving shaft member and having the other end held against the other of the output shaft member and the driving shaft member in a response to movement of the output shaft member, a one-way clutch disposed between the output shaft member and the driving shaft member, a ball retained in a through-hole in a manner movable in a radial direction of the other of the output shaft member and the driving shaft member, the through-hole being defined in the other of the output shaft member and the driving shaft member, the ball being possible to project beyond the cylindrical member on the other of the output shaft member and the driving shaft member along an outer circumference of the cylindrical member, the ball further being possible to abut an end of the clutch spring, and means for allowing the ball to protrude beyond the cylindrical member of the other of the output shaft member and the driving shaft member along the outer circumference of the cylindrical member in response to axial movement of the output shaft member against the pressing means, in which a revolving force is transmitted from the driving shaft member to the output shaft member through the clutch spring during normal rotation of the motor, thereby tightening a screw, but the revolving force is transmitted from the driving shaft member to the output shaft member through the one-way clutch during reverse rotation of the motor, thereby loosening the screw, the improvement comprising:

disengagement means for releasing engagement between the clutch spring and the ball during the reverse rotation of the motor, wherein the disengagement means includes a slanted surface and a through-hole, the slanted surface being formed on the clutch spring at the end of the clutch spring where the ball and the clutch spring are forced against one another when the motor is reversely rotated, the through-hole being shaped to permit the ball to be moved away from an immovable shaft member when the ball and the clutch spring are driven against one another during the reverse rotation of the motor, part of the clutch spring being secured to the immovable shaft member.

* * * * *